US007264762B2

(12) United States Patent
Ko et al.

(10) Patent No.: US 7,264,762 B2
(45) Date of Patent: Sep. 4, 2007

(54) ELECTROSPINNING ULTRAFINE CONDUCTIVE POLYMERIC FIBERS

(75) Inventors: Frank K. Ko, Philadelphia, PA (US); Alan G. MacDiarmid, Drexel Hill, PA (US); Ian D. Norris, Santa Fe, NM (US); Manal Shaker, Pratsville, AL (US); Ryzard M. Lec, Philadelphia, PA (US)

(73) Assignees: Drexel University, Philadelphia, PA (US); Trustees of the University of Pennsylvania, Philadelphia, PA (US)

( * ) Notice: Subject to any disclaimer, the term of this patent is extended or adjusted under 35 U.S.C. 154(b) by 190 days.

(21) Appl. No.: 10/169,216

(22) PCT Filed: Jan. 5, 2001

(86) PCT No.: PCT/US01/00327

§ 371 (c)(1),
(2), (4) Date: Feb. 12, 2003

(87) PCT Pub. No.: WO01/51690

PCT Pub. Date: Jul. 19, 2001

(65) Prior Publication Data

US 2003/0137083 A1 Jul. 24, 2003

Related U.S. Application Data

(60) Provisional application No. 60/174,757, filed on Jan. 6, 2000.

(51) Int. Cl.
*D01F 1/09* (2006.01)
*H05B 7/00* (2006.01)

(52) U.S. Cl. ..... 264/465

(58) Field of Classification Search ..... 264/10, 264/449, 465

See application file for complete search history.

(56) References Cited

U.S. PATENT DOCUMENTS

| | | | | |
|---|---|---|---|---|
| 4,143,196 | A * | 3/1979 | Simm et al. | 264/10 X |
| 4,657,793 | A * | 4/1987 | Fisher | 138/140 |
| 6,110,590 | A | 8/2000 | Zarkoob et al. | 428/364 |
| 6,800,155 | B2 * | 10/2004 | Senecal et al. | 156/62.4 |

OTHER PUBLICATIONS

Reneker and Chun, "Nanometre diameter fibres of polymer, produced by electrospinning", Nanotechology 1996 7:216-223.

* cited by examiner

*Primary Examiner*—Leo B. Tentoni
(74) *Attorney, Agent, or Firm*—Licata & Tyrrell P.C.

(57) ABSTRACT

A process of making conductive polymeric fibers by electrospinning fibers from a blend of polymers dissolved in an organic solvent includes generating a high voltage electric field between oppositely charged polymer fluid in a glass syringe (4) with a capillary tip (5) and a metallic collection screen (2) and causing a polymer jet (3) to flow to the screen (2) as solvent evaporates and collecting fibers on the screen (2).

2 Claims, 1 Drawing Sheet

ELECTROSPINNING ULTRAFINE CONDUCTIVE POLYMERIC FIBERS

This patent application is the U.S. National Stage of International Application No. PCT/US01/00327, filed Jan. 5, 2001, which claims the benefit of priority from U.S. Provisional Application Serial No. 60/174,787, filed Jan. 6, 2000.

This invention was made in the course of research sponsored by the U.S. Army Research Office (Grant No. DAAH04-96-1-00180) and the Office of Naval Research (Grant No. N00014-92-J-1369). The U.S. Government may have certain rights in this invention.

FIELD OF THE INVENTION

The present invention relates to a new method for preparing conducting polymer fibers with submicron diameters via electrospinning of conducting polymer blends. Conducting polymer blend fibers produced in accordance with this new method have a significantly higher surface area than a cast film form of the same solution, but maintain similar spectroscopic properties and similar conductivity values to that of the cast film. The method of the present invention and products produced via this method can be used in the fabrication of simple electronic devices including, but not limited to, Schottky junctions, sensors, and actuators.

BACKGROUND OF THE INVENTION

As complimentary metal oxide semiconductor (CMOS) technologies are being scaled down towards nanocritical dimensions, it is expected that the problems relating to fabrication, design complexity and cost will eventually halt further CMOS developments. Industry analysts predict that by the year 2010 the accumulated problems related to the fabrication, design complexity and cost will effectively halt further CMOS developments. Accordingly, there is a need for new (IC) integrated circuit technologies that mitigate or eliminate the limitations of silicon technology.

One area of research has been in the field of conducting organic polymers. The rate of electrochemical reactions is proportional to the surface area of the electrode. The surface area of the electrode is thus very important in a number of well-established areas of conducting polymer research including chemically modified electrodes for biological and chemical sensors and electromechanical actuators.

Improvements in the surface area of conducting polymer electrodes has generally revolved around two methods for preparing electrodes: depositing of a thin layer of conducting polymer films onto thin threads woven into a fabric mesh and template-like polymerization. Template-like polymerization of conducting polymers involves polymerizing the monomer within the pores of a microporous and nanoporous membrane.

Traditionally, the spinning of conducting polymer fibers from solution by conventional wet-spinning techniques results in extruded fibers with a diameter of $\geqq 5$ μgm.

Recently, it was shown that polymer fibers of nanometer diameter could be electrospun from sulfuric acid into a coagulation bath (Reneker, D. H. and Chun, I. Nanotechnology 1996 7:216). In these studies more than 20 polymers including polyethylene oxide, nylon, polyimide, DNA, polyaramid and polyaniline were electrospun into electrically charged fibers which were then collected in sheets or other useful geometrical forms.

A method has now been developed for production of ultrafine conductive polymeric fibers from polymer blends such as a polyaniline/polyethylene oxide blend dissolved in organic solvents such as chloroform. As demonstrated herein, polyaniline blend fibers produced via this method exhibit unique characteristics electroactive in nature.

SUMMARY OF THE INVENTION

An object of the present invention is to provide a method for producing conductive polymeric fibers from blends of polymers which comprises electrospinning fibers from a blend of polymers dissolved in organic solvent.

Another object of the present invention is to provide conductive polymeric fibers prepared via electrospinning of blends of polymers dissolved in organic solvent.

Yet another object of the present invention is to provide simple electronic devices comprising conductive polymeric fibers prepared via electrospinning of blends of polymers dissolved in organic solvent.

DETAILED DESCRIPTION OF THE INVENTION

Figure 1:
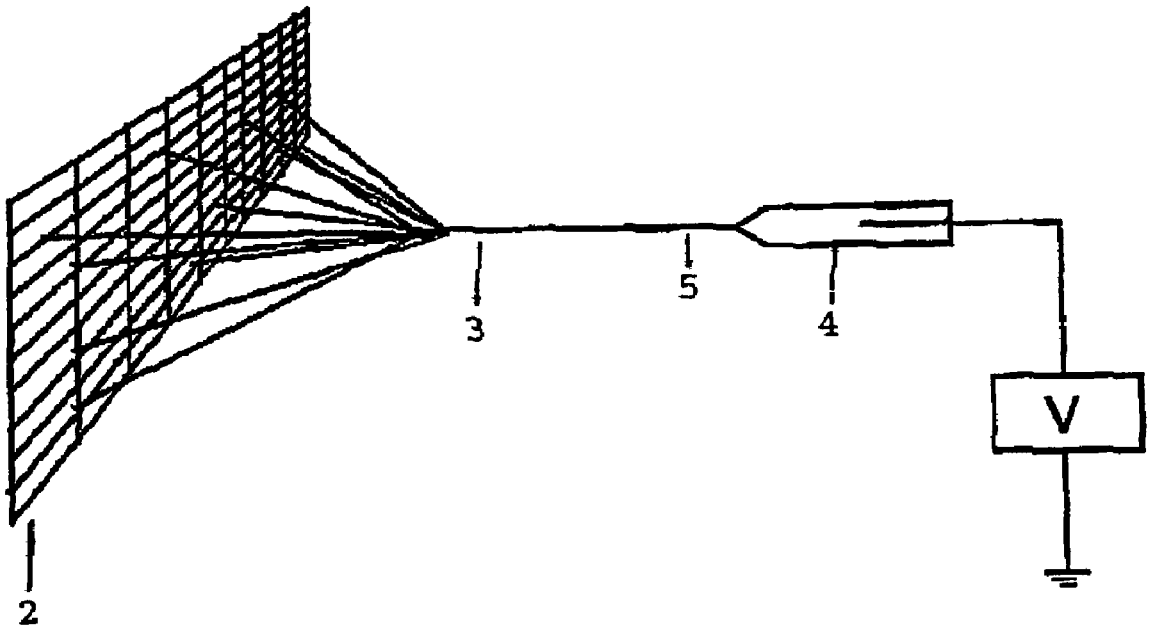
FIG. 1 shows a schematic diagram of an electrospinning process.

The present invention relates to a new approach to nanoelectronics via the application and combination of the field of electro-spun organic fibers with the electronic or conducting organic polymer field.

Electronic polymers are organic polymers which can be controllably synthesized, fabricated and doped and de-doped (chemically or electrochemically) through the insulating-semiconducting-metallic regimes.

Electrospinning is a simple and low cost electrostatic self-assembly method capable of fabricating a large variety of long, meter-length, organic polymer fibers approximately 40 nm to 2 μm diameter, in linear, 2-D and 3-D architecture. Electrospinning techniques have been available since the 1930's (U.S. Pat. No. 1,975,504). In the electrospinning process, a high voltage electric field is generated between oppositely charged polymer fluid contained in a glass syringe with a capillary tip and a metallic collection screen. As the voltage is increased, the charged polymer solution is attracted to the screen. Once the voltage reaches a critical value, the charge overcomes the surface tension of the suspended polymer cone formed on the capillary tip of the syringe of the glass pipette and a jet of ultrafine fibers is produced. As the charged fibers are splayed, the solvent quickly evaporates and the fibers are accumulated randomly on the surface of the collection screen. This results in a nonwoven mesh of nano and micron scale fibers. Varying the charge density, polymer solution concentration and the duration of electrospinning can control the fiber diameter and mesh thickness. A schematic of an electrospinning process depicting the nano or micro fiber collector 2, the polymer jet 3, the syringe 4 and capillary tip 5 containing the polymer solution, is shown in FIG. 1. Recently, electrospinning techniques have been applied to the production of high performance filters (Doshi, J. and Reneker, D. H. Journal of Electrostatics 1995 35:151; Gibson et al. AIChE Journal 1999 45:190) and for scaffolds in tissue engineering (Doshi, J. and Reneker, D. H. Journal of Electrostatics 1995 35:151; Ko et al. "The Dynamics of Cell-Fiber Architecture Interaction," Proceedings, Annual Meeting, Biomaterials Research Society, San Diego, Calif., April 1998).

In the present invention, electrospinning is used to produce nanofibers from polymer blends for fabrication of simple electronic devices such as a Schottky junction, sensors, and actuators. Examples of polymers useful in these blends include, but are not limited to, polyethylene oxide, polyaniline and polyacrylonitrile. Use of polymers blends enables tailoring of a wide range of functions including, but not limited to, conductive electro-active polymers. For example, the method of the present invention enables the electrospinning of polymers, oligomers and other matters including metallic salts that can not be electrospun as pure compounds. Further, the fibrous nature of the nanofiber electronic technology facilitates elementary design using fiber beams as structural elements and consequently offers design simplicity as well as open 3-D structure which favors efficient heat dissipation. The conducting polymer fibers produced via this method can be formed into fibrous networks that have interconnected or welded joints by controlling the state of solidification during the electrospinning process. Nano-metal fibers, referred to herein as nanowires, can also be produced by coating a conventional nanofiber with a metal by electrodeless deposition from solution or by metal vaporization. In addition, p- or n-doped nano-electronic electrospun fibers can be welded to a metal-coated nanofiber and nanojunctions such as a p/I/n junction can be created by welding appropriate fibers through consecutive deposition of alternative systems of nanofibers on top of each other. Nanofibers with junctions within the fibers themselves can also be created by changing the composition of the polymer feed solution supplied by the anode source jet.

The method of the present invention was used to electrospin nanofibers of conducting polymers and blends thereof. These nanofibers were prepared from polyaniline doped with camphorsulfonic acid (PAn.HCSA) blended with polyethylene oxide (PEO). It was found that at least 2 wt % PEO is essential in the blend as no fiber formation occurs in PAn.HCSA dissolved in chloroform alone since the viscosity and surface tension of the solution is not high enough to maintain a stable drop at the end of the capillary tip. Further, addition of more doped polyaniline does not increase the viscosity of the polymer solution as PAN.HCSA has a very low solubility in chloroform.

The morphology and fiber diameter of these electrospun polyaniline blend fibers were examined by SEM. Electrospun fibers from a 2 wt % PAn.HCSA/2 wt % PEO solution had a diameter ranging between 950 nm and 1.9 μm with a generally uniform thickness along the fiber. Similar diameters were observed for other concentration blends. Diameters of fibers prepared from PEO alone ranged from 950 nm to 2.1 μM. Thus, from the SEM micrographs of all the different polyaniline/PEO blends electrospun, it appears that the addition of PAn.HCSA to the PEO solution has little effect on the diameter of the fiber.

Electroactive characteristics of the fibers including electronic, magnetic and optical properties as well as associated properties which respond to external influences were determined.

The room temperature conductivity of the PAn.HCSA/PEO electrospun fibers and cast films was determined at various ratios of polyaniline and polyethylene oxide in the blend. Conductivity of the electrospun fibers was significantly lower in the non-woven mat as compared to cast films at the same polyaniline concentration. This is to be expected as the four-point probe method measures the volume resistivity from which the conductivity can then be calculated and not the individual fiber. Since electrospun fibers of the non-woven mat are highly porous, the polyaniline blend occupies less space than in a cast film. However, it is expected that the conductivity of an individual electrospun fiber will be higher than that of the non-woven mat and in fact should be equal to the conductivity of the cast film.

The experimental results for the conductivity of the cast film show similar trends to those reported previously for the conductivity of films cast from NMP of polyaniline doped with trifluoromethane sulfonimide acid and blended with polyethylene oxide (Sixou et al. Physical Review B 1997 56:4604). For doped polyaniline blended with PEO, the percolation threshold was approximately 4%. This is significantly higher than the percolation threshold of less than 1% reported for blends of polyaniline doped with camphorsulfonic acid and poly(methyl methacrylate) (PMMA) and nylon (Cao et al. Synthetic Metals 1993 55-57:3514 and Yoon et al. Synthetic Metals 1994 63:47). The percolation threshold for the PAn.HCSA/PEO blend is also significantly higher that for the PAn.HCSA blended with PMMA, thus indicating that PAn.HCSA interpenetrates more readily in nylon and PMMA resulting in a more entangled network of polymer chains than with PEO.

The fibers and films of PAn.HCSA/PEO blends were also characterized via spectroscopy. The uv-visible spectra of various PAn.HCSA/PEO blend films were determined. The films were cast onto glass slides from chloroform after the solution was allowed to stir for 24 hours. The absorption spectra for the different blends showed three absorption bands in the visible region which are consistent with the emeraldine salt form of polyaniline, as both PEO and HCSA have absorption bands less than 300 nm (Stafstrom et al. Physics Review Letters 1987 59:1464). The position of the two lower wavelength absorption bands at 352 and 430 nm (assigned as the benzenoid $\pi$-$\pi^*$ transition and a low wavelength polaron band, respectively) did not change significantly with the concentration of polyaniline in the blend. However, as the concentration of PEO in the blend increased, the position of the high wavelength localized polaron band shifted to lower wavelengths. The position of this band blue-shifted from 793 nm for the pure PAn.HCSA film to 763 nm for the 33 wt % PAn.HCSA/PEO blend (2 wt % PAn.HCSA/4 wt % PEO). It has been shown that when the emeraldine base is doped with camphorsulfonic acid in chloroform to form a 2 wt % solution, the high wavelength localized polaron band of the PAn.(±)-HCSA formed gradually shifts from 730 nm to 800 nm over 72 hours (Zheng et al. Synthetic Metals 1997 84:109). The shift in position of the localized polaron band is believed to arise from the slow de-aggregation of the polyaniline chains in solution. With stirring, the aggregated/cross-linked emeraldine base chains gradually become disentangled after protonation with HCSA resulting in an increased conjugation length for the polyaniline chains and the observed red shift of the polaron band. The position of the localized polaron band for the pure PAn.HCSA film is in agreement with the position of this band as determined by Zheng et al. However, the blue shift of the localized polaron band as the concentration of PEO is increase is believed to be due to the polyaniline chains becoming entangled with the PEO chains in solution, thus inhibiting the rate of de-aggregation of the polyaniline chains.

It has been proposed that polyaniline can exist in two distinct conformations: the crystalline, extended coil conformation which is highly conducting and the amorphous, compact coil conformation which is less conducting (MacDiarmid, A. G. and Epstein, A. J. Synthetic Metals 1994 65:103 and MacDiarmid, A. G. and Epstein, A. J. Synthetic Metals 1995 69:82). Since the above cast films exhibited an intense, well-defined polaron band between 760 and 790 nm and no significant near-infrared absorption, it is believed that they have a compact coil conformation for the polyaniline chains, which explains the low conductivity observed for the polyaniline blends.

The uv-visible spectra of different PAn.HCSA/PEO blend fibers electrospun onto a glass slide that was placed just in front of a copper target showed identical spectra to the cast films. Both the cast films and the electrospun fibers were prepared after 24 hours of stirring so that the peaks of the absorption bands would be directly comparable to those observed in the cast films. The spectra for the electrospun fibers showed a $\pi$-$\pi^*$ transition at 352 nm and a low wavelength polaron band at 420 nm, which are again independent of the PEO concentration. However, as was observed for the cast film, the position of the localized polaron band varied between 766 nm for the 2 wt % PAn.HCSA/4 wt % PEO electrospun sample, and 785 nm for the 2 wt % PAn.HCSA/2 wt % PEO electrospun sample. The absorption spectra of the polyaniline blend electrospun fibers was consistent for polyaniline in the emeraldine salt oxidation state and no other absorption bands were observed in the visible region thus indicating that the high voltage used in electrospinning did not result in over-oxidation of the polyaniline chain. Over-oxidation causes the degradation of the polyaniline backbone that results in inferior electronic and mechanical properties in the polymer (Foot, P. J. S. and Simon, R. Phys. D. Appl. Phys. 1989 22:1598).

The de-doping of the electrospun PAn.HCSA/PEO fibers (11-50 wt % PAn.HCSA) was achieved by suspending the non-woven mat above the vapor of concentrated ammonium hydroxide solution. Within 3 seconds of exposing the non-woven mat to the ammonia vapor, the green non-woven fiber mat turned to blue indicating that the emeraldine salt in the blend fibers was converted to emeraldine base. Between 3 and 7 seconds, depending on the concentration of polyaniline in the blend, after the non-woven mat was removed from the ammonia source, the non-woven mat turned to the original green of the as-spun mat. This indicated that emeraldine base in the blend was completely converted back to the emeraldine salt form of polyaniline. The extremely high rate of de-doping/re-doping is believed to be due to the highly porous structure of the non-woven fiber mat. The high porosity of these mats allows the ammonia vapor to diffuse in and out of the fiber mat at much faster rates than for films cast from the same solutions.

The method of the present invention is particularly useful in enhancing the performance of existing conducting polymer electrodes, as the rates of electrochemical reactions are proportional to the surface area of the electrode. The surface area of the electrode is very important in a number of well-established areas of conducting polymer research including chemically modified electrodes for biological and chemical sensors and electromechanical actuators. Increasing the effective surface area of conducting polymer sensors via the instant method offers the opportunity for improved sensitivity over an expanded dynamic range and a faster response time. The larger surface-to-volume of conducting polymer actuators developed from fibers makes it possible for ions to migrate from the surrounding electrolyte into the interior of the conducting polymer fiber electrode at faster rates, so these devices will have a faster rate of deformation.

The following nonlimiting examples are provided to further illustrate the present invention.

EXAMPLES

Example 1

Solution Preparation

Polyethylene oxide (PEO) ($M_w$ 900,000 Dalton) and 10-camphorsulfonic acid (HCSA) and chloroform were purchased from Aldrich Chemical Co. Emeraldine base ($M_w$ 120,000 Dalton) was obtained from Neste Chemical Oy (Finland 02151, ESP00). These chemicals were used without further preparation.

Various polymer blend solutions were prepared with the concentration of polyaniline doped with HCSA (PAn-.HCSA) ranging from 0.5 to 2 wt % and the concentration of PEO ranging from 2 to 4 wt %. By varying the ratio of polyaniline to polyethylene oxide, the concentration of doped polyaniline in the blend varied between 11 wt % and 50 wt %. These polymer blend solutions were prepared by first dissolving the exact amount of HCSA required to fully dope the emeraldine base in chloroform. The emeraldine base was slowly added to the chloroform solution with vigorous stirring at room temperature. This solution was allowed to stir for 2 hours and subsequently filtered using a No. 42 Whatman filter paper to remove particulate matter. The PEO was then slowly added to the doped polyaniline solution over a period of 1 hour with vigorous stirring to obtain a homogeneous solution.

Example 2

Electrospinning

The electrospinning apparatus, as shown in FIG. 1, used a variable high voltage power supply purchased from Gamma High Voltage Research (Ormond Beach, Fla.). The glass pipette used in these experiments had a capillary tip diameter of 1.2 mm, and the pipette was tilted approximately 5° from horizontal so that a small drop was maintained at the capillary tip due to the surface tension of the solution. A positive potential was applied to the polymer blend solution, by inserting a copper wire into the glass pipette. The apparatus also consisted of a 10×10 cm copper plate placed 26 cm horizontally from the tip of the pipette as the grounded counter electrode. The potential difference between the pipette and the counter electrode used to electrospin the polymer solution was 25 kV.

Example 3

Characterization of the Electrospun Fibers

The fiber diameter and polymer morphology of the electrospun PAn.HCSA/PEO fibers were determined using scanning electron microscopy (SEM). A small section of the non woven mat was placed on the SEM sample holder and was sputter coated with gold via a Denton Desk-1 Sputter Coater (Denton Vacuum, Inc. Moorestown, N.J. 08057). An Amray 3000 SEM (Amray, Inc./KLA-Tencor Corp., Bedford, Mass.) using an accelerating voltage of 20 kV was employed to the take the SEM photographs.

The conductivity of the electrospun PAn.HCSA/PEO fibers and the cast film on a microscope glass was measured using the four-point probe method. The thickness of the non-woven fiber mat and the cast films were measured using a digital micrometer (Mitutoyo MTI Corp. Paramus, N.J.) with a resolution of 1 μm. The current was applied between the outer electrodes using a PAR 363 (Princeton Applied Research/Perkin Elmer Instruments, Inc., Oak Ridge, Tenn.) and the resulting potential drop between the inner electrodes was measured with a Keithley 169 multimeter (Keithley Instruments Inc., Cleveland, Ohio).

The polymer conformation of the electrospin fibers was determined using UV-visible spectroscopy by inserting a microscope glass slide into the path of the polymer jet in front of the copper target for 30 seconds. The UV-visible spectra of these fibers were measured between 300 and 1100 nm using a Perkin Elmer Lambda UV-visible-NIR spectrometer. As a comparison between the polymer blend in the solid state and as electrospun fibers, the same polymer blend solution used for electrospinning was also cast onto a microscope glass slide.

What is claimed is:

1. A method for producing conductive polymeric fibers comprising electrospinning conductive polymeric fibers from a blend of conducting polymers comprising polyaniline doped with camphorsulfonic acid and at least 2 wt % polyethylene oxide dissolved in an organic solvent.

2. The method of claim 1 wherein the blend of conducting polymers is dissolved in chloroform.

* * * * *